US005759164A

United States Patent [19]

Pacey

[11] Patent Number: 5,759,164

[45] Date of Patent: Jun. 2, 1998

[54] APPARATUS AND METHOD FOR TREATING EDEMA

[76] Inventor: John Allen Pacey, 206-6440 Royal Oak Avenue, Burnaby, British Columbia, Canada, V5H 3P2

[21] Appl. No.: 515,733

[22] Filed: Aug. 16, 1995

[51] Int. Cl.[6] ..... A61H 7/00

[52] U.S. Cl. ..... 601/151; 601/148

[58] Field of Search ..... 601/148, 149, 601/150, 151, 152

[56] References Cited

U.S. PATENT DOCUMENTS

| | | | |
|---|---|---|---|
| 2,694,395 | 11/1954 | Brown | 601/151 |
| 2,832,336 | 4/1958 | Davis et al. | 601/151 |
| 3,083,708 | 4/1963 | Gottfried | 601/151 |
| 3,186,404 | 6/1965 | Gardner | 601/151 |
| 3,977,396 | 8/1976 | Cartier | 601/151 |
| 4,149,529 | 4/1979 | Copeland et al. | 128/24.1 |
| 4,320,746 | 3/1982 | Arkans et al. | 601/152 |
| 4,648,392 | 3/1987 | Cartier et al. | 128/160 |
| 4,938,208 | 7/1990 | Dye | 128/87 R |
| 5,063,910 | 11/1991 | Cartier | 128/24 R |
| 5,167,227 | 12/1992 | Meserlian | 601/151 |

OTHER PUBLICATIONS

Lympha Press Mini, Camp International Inc., 1994.

*Primary Examiner*—Robert A. Hafer
*Assistant Examiner*—Benjamin K. Koo
*Attorney, Agent, or Firm*—Norman M. Cameron

[57] ABSTRACT

An apparatus and method for treating edema of a body member by pressure includes the use of a flexible, liquid-tight bag having connectors for securing the bag about the member. A liquid conduit, substantially smaller in section than the bag, is connected to the top thereof and is extended upwardly from the bag in use to increase hydraulic pressure in the bag and thereby pressure on the member when the conduit and the bag are filled with liquid.

6 Claims, 2 Drawing Sheets

APPARATUS AND METHOD FOR TREATING EDEMA

BACKGROUND OF THE INVENTION

This invention relates to bag-like apparatuses for treating edema or other types of swelling of body members by application of pressure.

The use of fluid pressure to treat edema is known in the art. For example, U.S. Pat. No. 4,648,392 to Cartier discloses a sleeve-like apparatus for treatment of edema of members. The device includes a flexible bag which fits about the limb. A fluidized granular material and mercury are used to apply pressure to the limb.

U.S. Pat. No. 5,063,910 shows a similar sleeve extending about the limb and filled with mercury or possibly some other high-density liquid.

U.S. Pat. No. 4,320,746 relates to a device for applying compressive pressure against a limb utilizing a sleeve with a plurality of separate fluid pressure chambers.

U.S. Pat. No. 4,938,208 shows a full length compressible sleeve. It mentions the use of a plurality of generally limb encircling compressive chambers.

U.S. Pat. No. 4,149,529 discloses the use of a reservoir with such a device.

Some prior art devices are relatively complicated, such as the device sold under the trademark Lympha Press. This device uses a sleeve extending about the limb with overlapping air compartments. A pump supplies air to these compartments and thereby applies pressure on the limb.

Many of the prior art devices offer significant disadvantages. Some of them are relatively complicated and are only really suitable for use on patients who are hospitalized or otherwise in bed. Some such earlier devices are not really useful at home while the patient is undergoing normal activities such as reading or watching television.

It is therefore an object of the invention to provide an improved device for treating edema or similar disorders which is relatively simple and rugged in construction and economical to produce and sell.

It is also an object of the invention to provide an improved device of the type which is portable and can be utilized by patients at home or at work.

It is a further object of the invention to provide an improved device of the type which provides significant pressure to counteract the effects of edema, but without requiring complicated pumps or the like.

SUMMARY OF THE INVENTION

According to the invention there is provided an apparatus for treating edema of a body member by pressure. There is a flexible, liquid tight container having connectors for securing about the member. The container has a top. There is a liquid conduit, substantially smaller in section than the container, connected to the top thereof and being extendable upwardly from the container in use to increase hydraulic pressure in the container and pressure on the member when the conduit and the container are filled with liquid.

There is provided according to another aspect of the invention a method of applying pressure to a portion of a body. A liquid filled bag is placed about the portion of the body, the bag having a top and a liquid conduit sealingly connected to the top. The conduit is extended upwardly above the portion of the body. The conduit is filled with liquid, thereby increasing hydraulic pressure in the bag and pressure on the portion of the body.

The invention offers significant advantages over many of the prior art devices. The concept of a liquid-filled bag extending about the limb to apply pressure is well known. The invention however increases this pressure beyond that achieved by a conventional liquid filled bag simply encircling the portion of the limb or other portion of the body involved. Hydrostatic head is utilized by having a liquid-filled conduit extending upwardly above the portion of the body. This is a simple and effective means of increasing pressure compared with pumps or the like which render some prior art devices complicated, relatively unportable and expensive.

Furthermore, the invention provides a device which is very simple and rugged in construction and therefore one which can be purchased by a patient. A patient does not therefore have to go to a clinic for treatment which is effectively the case with some relatively expensive prior art devices. At the same time safe liquids such as water may be utilized instead of poisonous substances such as mercury.

DESCRIPTION OF THE PREFERRED EMBODIMENTS

Figure 1:
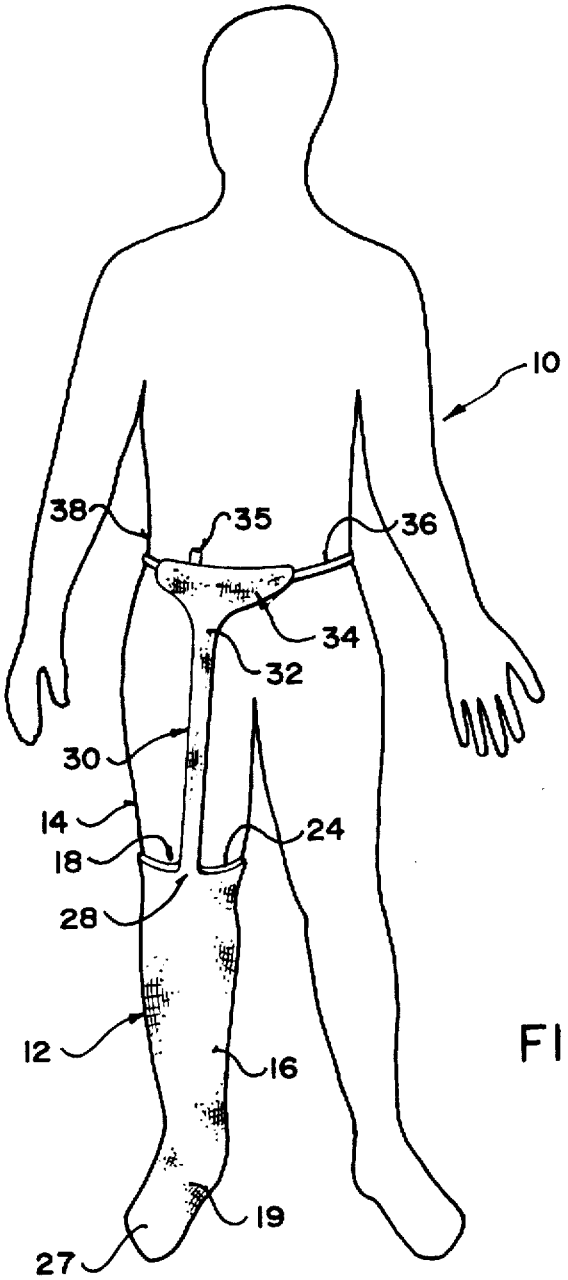
FIG. 1 is a simplified perspective view of a person wearing on one leg an apparatus for treating edema, according to an embodiment of the invention.

Referring to the drawings, and first to FIG. 1, this shows a person 10 wearing an apparatus 12 intended to treat edema in the person's leg 14, which happens to be the leg on the left from the point of view of FIG. 1. In this instance the edema occurs in the lower portion of the leg below the knee as is typical. The apparatus 12 accordingly has a flexible, liquid tight container or bag 16 which extends downwardly about leg 14 from a position adjacent knee 18 and over his or her foot 27. It should be understood however that the device can be utilized or adapted to fit other portions of the leg, other limbs or other portions of the person's body.

The bag 16 is sock-like and has a top 24 adjacent the knee 18 and a bottom 26 below foot 27. The bag is sealed apart from a relatively small opening 28 at the top of the bag. There is a conduit 30 sealingly connected about the opening 28. The conduit communicates internally with the bag. It may be seen that the conduit is substantially smaller in section than the bag, the bag having a section large enough to fit about the limb, and the conduit being relatively narrow and hose-like.

The conduit has a top 32 which is connected to a reservoir 34. Reservoir 34 is again substantially larger in section or internal expanse than the conduit and is therefore capable of holding a relatively significant volume of liquid. The reservoir in this embodiment is pouch or bag-like. It is secured to the person 10 in this example by a strap 36 extending about the person's waist 38.

Figure 2:
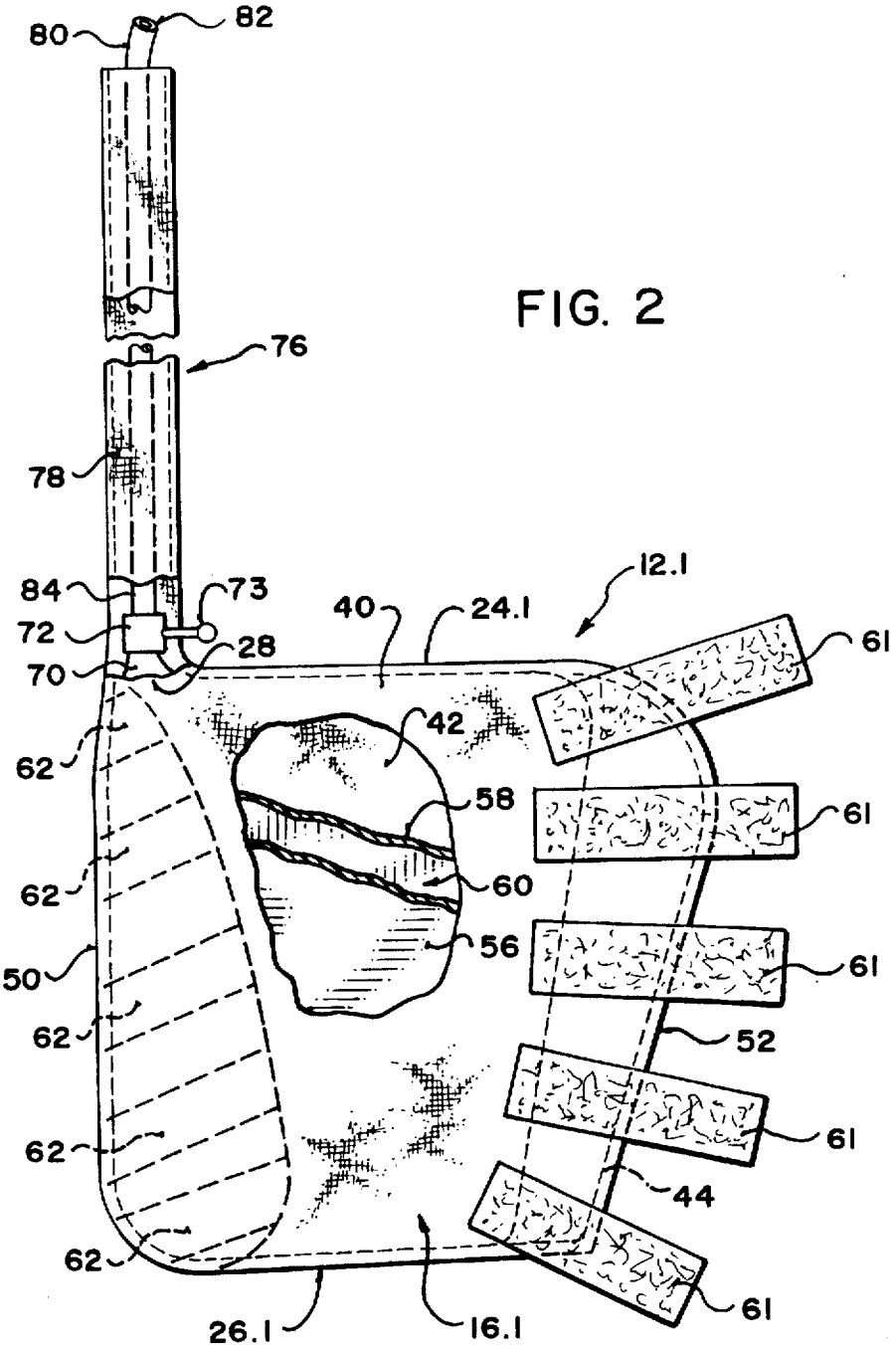
FIG. 2 is a front elevation of an apparatus for treating edema, according to another embodiment of the invention, shown unfolded and with a portion along one edge being turned over in stippled lines to show the reverse side thereof.

FIG. 2 shows structural details of another embodiment of the invention although it may be appreciated that other similar structures could be employed. In this example like parts have like numbers as in FIG. 1 with the additional designation ".1". Apparatus 12.1 includes a bag 16.1 which in this example is flat when empty and has two adjacent outer layers 40 and 42 which are made of waterproof nylon cloth. Other materials could be substituted. The outer layers are connected together by stitching 44 about the outer perimeters thereof. A suitable seam sealer is applied about the stitching. It may be seen that the outer layers are generally rectangular, having a top 24.1, a bottom 26.1 and opposite edges 50 and 52. However in this case edge 52 is angled inwardly from the top 24.1 of the bag to the bottom 26.1. This is so that the bag can conform better to the shape of the person's leg when fitted thereabout. The bag 16.1 fits about the leg similar to bag 16 in FIG. 1 but does not cover the foot. The shape can be varied, particularly for use on other limbs or other portions of the person's body.

The bag 16.1 also has a waterproof liner comprising two layers of flexible plastic 56 and 58 with a space 60 therebetween which contains the liquid, usually water. Alternatively, a relatively thick flexible plastic, such as vinyl, could replace both the outer layers and the liner in a less expensive variation.

The apparatus includes connectors for securing the bag about the member, in this particular instance leg 14. The connectors in this example are in the form of a plurality of mating hook and loop type fasteners 61 and 62. FIG. 2 shows five loop type portions 61 connected along edge 52. The number of fasteners is not critical however. Hook portions 62 of the fasteners are connected along the opposite edge 50 on the reverse side of the bag formed by the outside of layer 42 as shown by the folded over portion to the left of FIG. 2. The spacing of the portions 62 is similar to portions 61 so that the portions 61 and 62 mate when the bag 16.1 is wrapped around the limb snugly. It may be seen that the loop portions 61 are angled outwardly away from each other, particularly adjacent the top and bottom of the bag so that the portions of the connectors align better after the bag is wrapped around the leg. It may be appreciated that the positions of the hook and loop portions can be reversed, the number of fasteners changed and other means of connecting can be substituted. Examples are snap fasteners, buttons, laces and belts.

The bag 16.1 has a neck 70 adjacent its top 24.1. A valve 72, operated by knob 73, is sealingly connected to the liners 56 and 58 at the neck 70 so as to inhibit liquids from moving out of the bag and thereby maintaining pressure therein. Other types of valves, such as one-way valves, could be substituted or the valve may be deleted.

A conduit 76 is connected to the bag 16.1 at neck 70. The conduit 70 can be detachably connected to the valve so the conduit and reservoir 34 can be removed after the valve is closed. The conduit includes an outer portion 78, also of two layers of nylon cloth in this example and connected to outer layers 40 and 42 of the bag. The conduit also includes an internal flexible hose 80 having a top 82 and a bottom 84 connected to valve 72. In this example the hose is of flexible nylon tubing although alternatives may be used instead. It may be seen that the internal expanse or cross section of the hose is substantially smaller than that of the bag.

Operation

The purpose of the invention is to apply pressure to a portion of the body with some affliction such as edema. The apparatus is also useful for treating an injured limb by providing support to the limb at the same time it reduces edema. The apparatus is also useful for accelerating stump shrinkage after amputation of a limb, to stabilize fractures and for treatment of sprains, such as sprained ankles.

In this particular instance the portion of the body treated is the lower part of leg 14 of person 10 shown in FIG. 1. Bag 16 is placed about the leg below the knee and about the foot as illustrated. In the case of bag 16.1, only the leg is covered by wrapping the bag about the leg and connecting together loop portions 61 and hook portions 62 of the fasteners. Referring back to FIG. 1, the conduit 30 is then extended upwardly above the portion of the body being treated as illustrated. In this particular example the conduit is high enough to reach the waist of the person. Reservoir 34 is located at this position and is held about the waist by strap 36. The reservoir is not essential however and can be deleted as shown in the embodiment of FIG. 2. In the case of FIG. 1 the reservoir 34, the conduit 30 and bag 16 are filled with liquid through a cap 35 on the top of the reservoir. The bag can be pre-filled with liquid, but should be topped up after the apparatus is in place as shown so that the reservoir is filled.

The arrangement shown in FIG. 1 results in increased hydrostatic pressure in bag 16 beyond the pressure which would be applied to the limb if the bag alone were filled with liquid. The additional height of the column from top 24 of the bag to the reservoir 34 increases the pressure in the bag and accordingly the pressure against the limb as desired for the treatment of edema or some similar ailments.

It will be understood by someone skilled in the art that many of the details described above are by way of example only and are not intended to limit the scope of the invention which is to be interpreted with reference to the following claims.

What is claimed is:

1. An apparatus for treating edema of a body member of a patient by pressure, comprising:

a flexible, liquid tight container having means for securing the container about the member, the container having a top;

a conduit for liquid, substantially smaller in section than the container, connected to the top thereof and being extendable upwardly from the container in use to increase hydraulic pressure in the container and therefore pressure on the member when the conduit and the container are filled with liquid;

a liquid reservoir at the top of the conduit; and means for connecting the reservoir to a portion of the body of the patient between the patient's head and the member.

2. An apparatus as claimed in claim 1, wherein the container is a bag of a flexible sheet-like material and the means for securing includes mating connectors along opposite edges thereof, whereby the bag can be wrapped completely around the member so the edges are adjacent each other and the mating connectors along the edges can be connected to each other.

3. An apparatus as claimed in claim 2, wherein the bag is of fabric with a waterproof lining.

4. An apparatus as claimed in claim 1, wherein the conduit includes a flexible hose.

5. An apparatus as claimed in claim 1, further including a valve adjacent the top of the container.

6. A method for applying pressure to a portion of a person's body, comprising the steps of:

placing a liquid filled bag about the portion of the body, the bag having a top, a liquid conduit sealingly connected to the top, the conduit communicating internally with the bag, the conduit having a top with a reservoir connected thereto;

extending the conduit upwardly above the portion of the body; and filling the reservoir with liquid and securing the reservoir to a position above the portion of the body; and filling the conduit and bag with liquid from the reservoir, thereby increasing pressure in the bag and pressure on the portion of the body.

* * * * *